US007449269B2

(12) United States Patent
Sugimura

(10) Patent No.: US 7,449,269 B2
(45) Date of Patent: Nov. 11, 2008

(54) ELECTROPHOTOGRAPHIC PHOTORECEPTOR HAVING DEFINED MOBILITY OF ELECTRIC CHARGES IN PHOTOSENSITIVE LAYER AND IMAGE FORMING DEVICE INCORPORATING SAME

(75) Inventor: Hiroshi Sugimura, Habikino (JP)

(73) Assignee: Sharp Kabushiki Kaisha, Osaka (JP)

( * ) Notice: Subject to any disclaimer, the term of this patent is extended or adjusted under 35 U.S.C. 154(b) by 430 days.

(21) Appl. No.: 11/034,048

(22) Filed: Jan. 13, 2005

(65) Prior Publication Data

US 2005/0153222 A1 Jul. 14, 2005

(30) Foreign Application Priority Data

Jan. 14, 2004 (JP) ..... 2004-006620

(51) Int. Cl.
*G03G 5/047* (2006.01)
*G03G 5/06* (2006.01)

(52) U.S. Cl. ..... 430/58.85; 430/59.5; 430/72; 399/159

(58) Field of Classification Search ..... 430/58.85, 430/60, 72, 58.05, 59.5; 399/159
See application file for complete search history.

(56) References Cited

U.S. PATENT DOCUMENTS

| | | | | |
|---|---|---|---|---|
| 5,747,208 | A | 5/1998 | Ueda | |
| 5,981,127 | A | 11/1999 | Nishiguchi et al. | |
| 6,122,468 | A | 9/2000 | Sakamoto et al. | |
| 6,521,386 | B1 | 2/2003 | Sakon et al. | |
| 2003/0218665 | A1 | 11/2003 | Yasutomi et al. | |
| 2004/0101770 | A1 * | 5/2004 | Obata et al. | 430/58.85 |
| 2006/0222979 | A1 * | 10/2006 | Ishida et al. | 430/72 |

FOREIGN PATENT DOCUMENTS

| | | | |
|---|---|---|---|
| JP | 7-134430 | A | 5/1995 |
| JP | 10-83120 | A | 3/1998 |
| JP | 2833222 | B2 | 10/1998 |
| JP | 11-72934 | A | 3/1999 |
| JP | 2000-305298 | A | 11/2000 |
| JP | 2001-324825 | A | 11/2001 |
| JP | 2002-55516 | A | 2/2002 |
| JP | 2002-174911 | A | 6/2002 |
| JP | 2002-365820 | A | 12/2002 |
| JP | 2003-29527 | A | 1/2003 |
| JP | 2003-43783 | A | 2/2003 |
| JP | 2003-98700 | A | 4/2003 |
| JP | 2003-167441 | A | 6/2003 |
| JP | 2003-176271 | A | 6/2003 |
| JP | 2003-195536 | A | 7/2003 |
| JP | 2003-287912 | A | 10/2003 |
| JP | 2003-322984 | A | 11/2003 |
| JP | 2003-335738 | A | 11/2003 |
| WO | WO 2004095144 | A1 * | 11/2004 |

OTHER PUBLICATIONS

Machine translation of JP 2002-365820 (Dec. 2002).*
Machine translation of JP 2003-012619 (Jan. 2003).*
Diamond, Arthur S & David Weiss (eds.) Handbook of Imaging Materials, 2nd ed.. New York: Marcel-Dekker, Inc. (Nov. 2001) pp. 145-164.*

* cited by examiner

*Primary Examiner*—Christopher RoDee
(74) *Attorney, Agent, or Firm*—Nixon & Vanderhye P.C.

(57) ABSTRACT

The invention provides an electrophotographic photoreceptor capable of producing high quality images even when development is carried out under low electric potential conditions, and also provides an image forming device incorporating such an electrophotographic photoreceptor. In a photosensitive layer 14 of a photoreceptor 1, the mobility of electric charges is $2\times10^{-6}$ $cm^2/(V\cdot s)$ or greater at an electric field intensity E of $1\times10^5$ V/cm. Further, the slope $\alpha$ in equation 1 representing the mobility of electric charges is $5\times10^{-4}$ or less in an electric field range of $5\times10^4<E<1\times10^5$.

11 Claims, 3 Drawing Sheets

ELECTROPHOTOGRAPHIC PHOTORECEPTOR HAVING DEFINED MOBILITY OF ELECTRIC CHARGES IN PHOTOSENSITIVE LAYER AND IMAGE FORMING DEVICE INCORPORATING SAME

This Nonprovisional application claims priority under 35 U.S.C. § 119(a) on patent application No. 2004-006620 filed in Japan on Jan. 14, 2004, the entire contents of which are hereby incorporated by reference.

FIELD OF THE INVENTION

The present invention relates to electrophotographic photoreceptors for use in printers, facsimiles, copying machines, and other electrophotographic devices. The invention also relates to image forming devices incorporating such photoreceptors.

BACKGROUND OF THE INVENTION

In order to form an electrostatic latent image, an electrophotographic image forming device electrically neutralizes the surface charge on a photoreceptor by exposing the photoreceptor according to image data. To achieve this, a photosensitive layer of the photoreceptor typically contains a charge generating substance which generates electric charges when irradiated with light, and a charge transporting substance which transports the generated electric charges.

It is desired that a photoreceptor with such a photosensitive layer allows for swift movement of electric charges by the charge transporting substance. In other words, the electric charges generated by the photosensitive layer as a result of exposure need to move to the photoreceptor surface and cancel the surface charge on the photoreceptor within a period from the charging of the photoreceptor to the development of the electrostatic latent image. If the surface charge is canceled only insufficiently, the exposed area does not make a good contrast in electric potential to the non-exposed area. A decrease in electric potential contrast will lead to a decrease in image density and render a white background appear gray.

Addressing these problems by specifying the mobility of electric charges generated in the photosensitive layer of the photoreceptor, patent documents 1 to 5 disclose image forming devices capable of producing high quality images. For example, patent documents 1 to 3 specify the electric charge mobility in the photosensitive layer in intense electric fields on the order of $10^5$ V/cm.

Meanwhile, recent years have seen growing demand for development under low potential conditions, in order to achieve low power consumption in the developer device, reduced toner consumption, and improved durability for the photoreceptor, among others. To deliver quality development under low potential conditions, developing devices and developers are being improved (see, for example, patent documents 6 to 10). Patent document 10 discloses an image forming device which improves the durability of the photoreceptor by the use of a developer having a predetermined coloring ability to ensure a necessary post-fusion image density. The device can lower the amount of developer used per print.

(Patent Document 1)

Japanese patent 3227956 (registered Sep. 7, 2001), corresponding to U.S. Pat. No. 5,747,208.

(Patent Document 2)

Japanese publication of unexamined patent application 2000-305289 (Tokukai 2000-305289; published Nov. 2, 2000), corresponding to U.S. Pat. No. 6,521,386.

(Patent Document 3)

Japanese publication of unexamined patent application 2003-195536 (Tokukai 2003-195536; published Jul. 9, 2003)

(Patent Document 4)

Japanese patent 2833222 (registered Oct. 2, 1998)

(Patent Document 5)

Japanese publication of unexamined patent application 2001-324825 (Tokukai 2001-324825; published Nov. 22, 2001)

(Patent Document 6)

Japanese publication of unexamined patent application 10-83120 (Tokukaihei 10-83120/1998; published Mar. 31,1998)

(Patent Document 7)

Japanese publication of unexamined patent application 2003-29527 (Tokukai 2003-29527; published Jan. 31, 2003)

(Patent Document 8)

Japanese publication of unexamined patent application 2003-43783 (Tokukai 2003-43783; published on Feb. 14, 2003)

(Patent Document 9)

Japanese publication of unexamined patent application 2003-167441 (Tokukai 2003-167441; published on Jun. 13, 2003)

(Patent Document 10)

Japanese publication of unexamined patent application 2000-122355 (Tokukai 2000-122355; published on Apr. 28, 2000), corresponding to U.S. Pat. No. 6,122,468.

Patent documents 1 to 10 are silent about photoreceptors suitable for use in development under low potential conditions.

Electric charge mobility in a photoreceptor generally varies with an electric field. As such, the mobility of charge in the photoreceptor decreases under low potential conditions where the photoreceptor is charged only to a low potential. More specifically, electric charge mobility can be so low under low potential conditions that the electric charges generated in the photosensitive layer may not sufficiently move within a period from the exposure of the photoreceptor to the development. If the development is carried out with the exposed area remaining at a high potential, the exposed area does not make a good contrast in electric potential to the non-exposed area. A decrease in electric potential contrast will lead to a decrease in image density and render a white background appear gray. In order to deliver quality image production under low potential conditions, the electric charge mobility in the photosensitive layer in the photoreceptor needs be specified under low potential conditions.

SUMMARY OF THE INVENTION

The present invention, conceived to solve these conventional problems, has an objective to provide an electrophotographic photoreceptor capable of developing under low potential conditions and still forming high quality images, as well as an image forming device incorporating such a photoreceptor.

An electrophotographic photoreceptor in accordance with the present invention, to solve the problems, is an electrophotographic photoreceptor including a photosensitive layer on a conductive support, the photosensitive layer containing at least a charge generating substance and a charge transporting substance, a mobility of electric charges in the photosensitive layer in an electric field having an intensity of $1\times10^5$ V/cm being $2\times10^{-6}$ $cm^2/(V\cdot s)$ or greater, and a slope a in equation 1 being $5\times10^{-4}$ or less:

$$\log \mu = a\times\sqrt{E}+b \quad \text{(Eq.1)}$$

where μ is the mobility, in $cm^2/(V\cdot s)$, of the electric charges in the photosensitive layer at $5\times10^4$ V/cm<E<$1\times10^5$ V/cm, where E is an intensity of an electric field, and a and b are real numbers.

According to the arrangement, even when the electric potential to which the electrophotographic photoreceptor is charged is set to a relatively low value, it is ensured that the electric charges generated in the photosensitive layer have a sufficient mobility.

Therefore, electric charges can quickly move to the surface of the electrophotographic photoreceptor in a short time even under low electric potential conditions. Thus, a sufficient contrast in electric potential can be ensured between exposed and non-exposed parts on the surface of the electrophotographic photoreceptor. Using the electrophotographic photoreceptor, images are formed with sufficient density, high resolution, and high quality even under low electric potential conditions.

An image forming device in accordance with the present invention, to solve the problems, is adapted to include the electrophotography photoreceptor.

According to the arrangement, the device incorporates an electrophotographic photoreceptor with a photosensitive layer having an excellent electric charge mobility. The resultant image forming device can produce good quality images under low electric potential conditions with a small amount of developer, thereby realizing an image forming device that can form high quality images at low cost.

Additional objects, advantages and novel features of the invention will be set forth in part in the description which follows, and in part will become apparent to those skilled in the art upon examination of the following or may be learned by practice of the invention.

DESCRIPTION OF THE EMBODIMENTS

Figure 1:
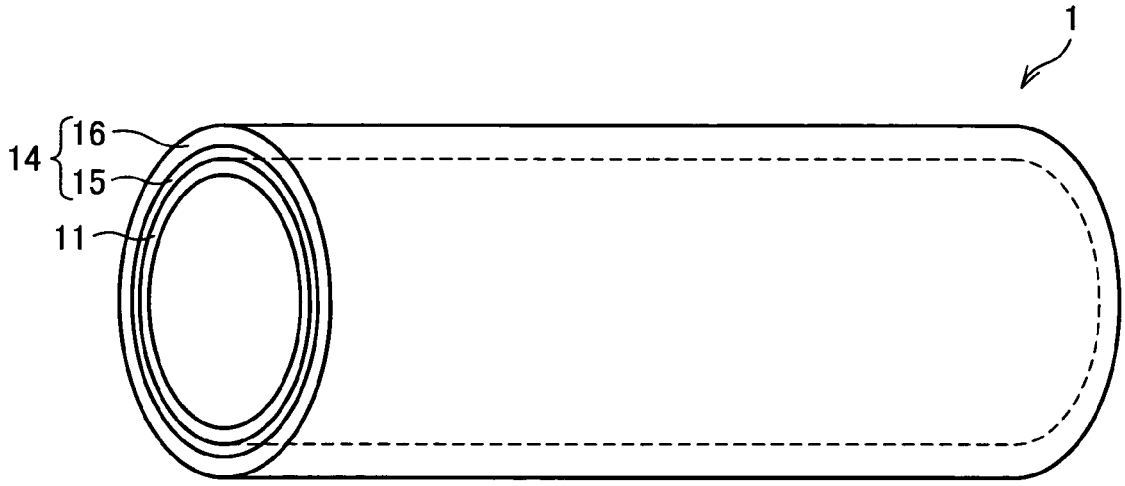
FIG. 1(*a*) is a perspective view of an embodiment of the electrophotographic photoreceptor, and FIG. 1(*b*) is a cross-sectional view of a part of the electrophotographic photoreceptor.
Figure 1:
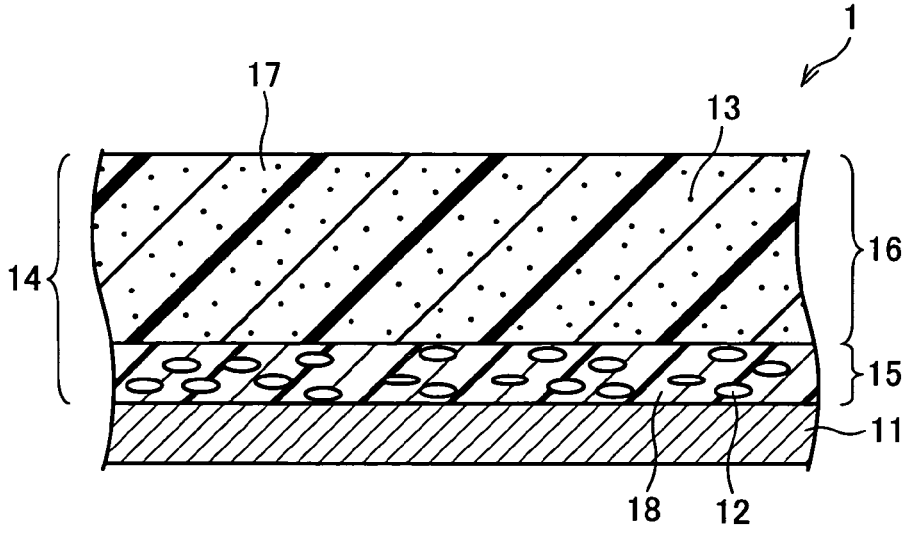
Figure 2:
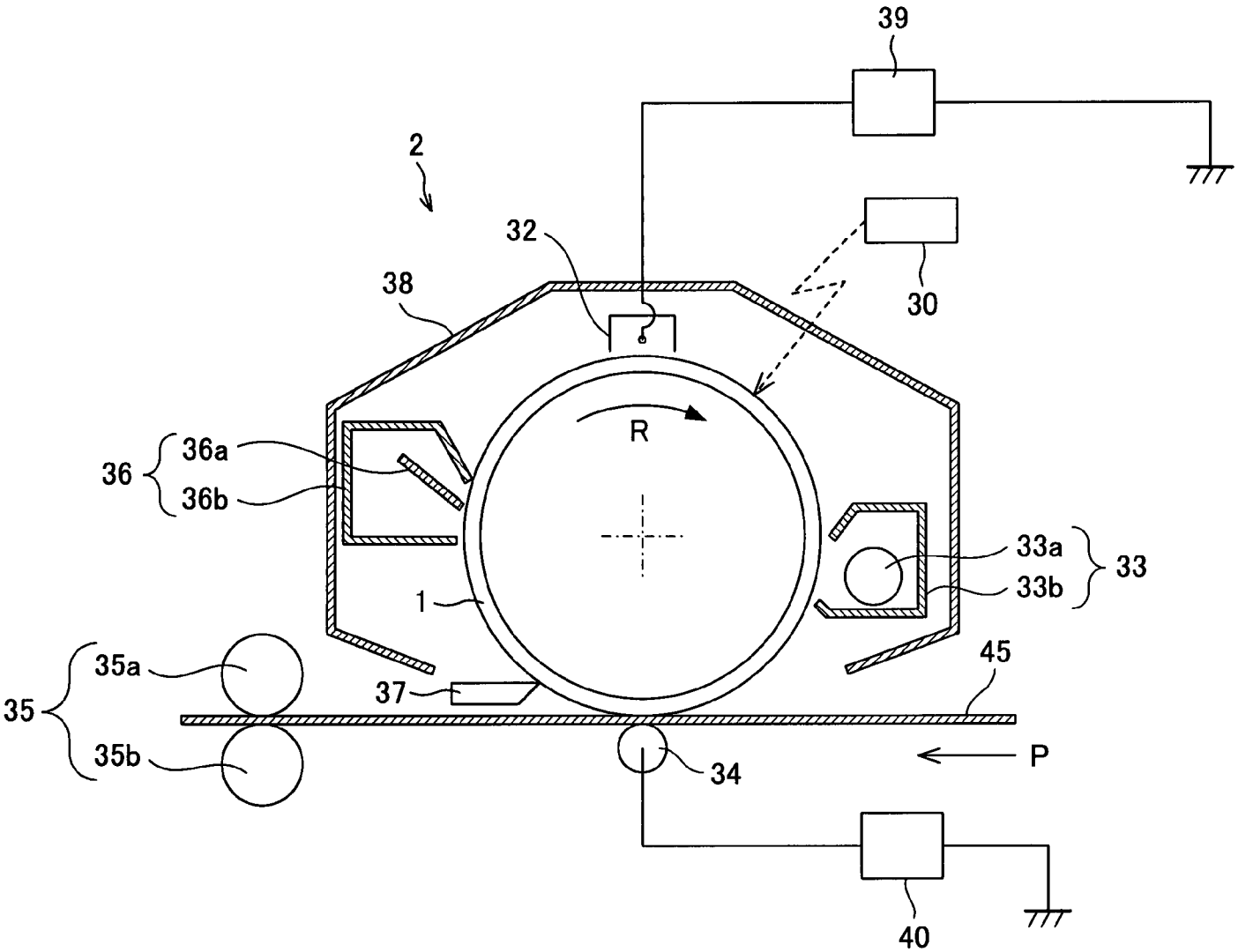
FIG. 2 is a schematic side view of an embodiment of an image forming device incorporating the electrophotographic photoreceptor.
Figure 3:
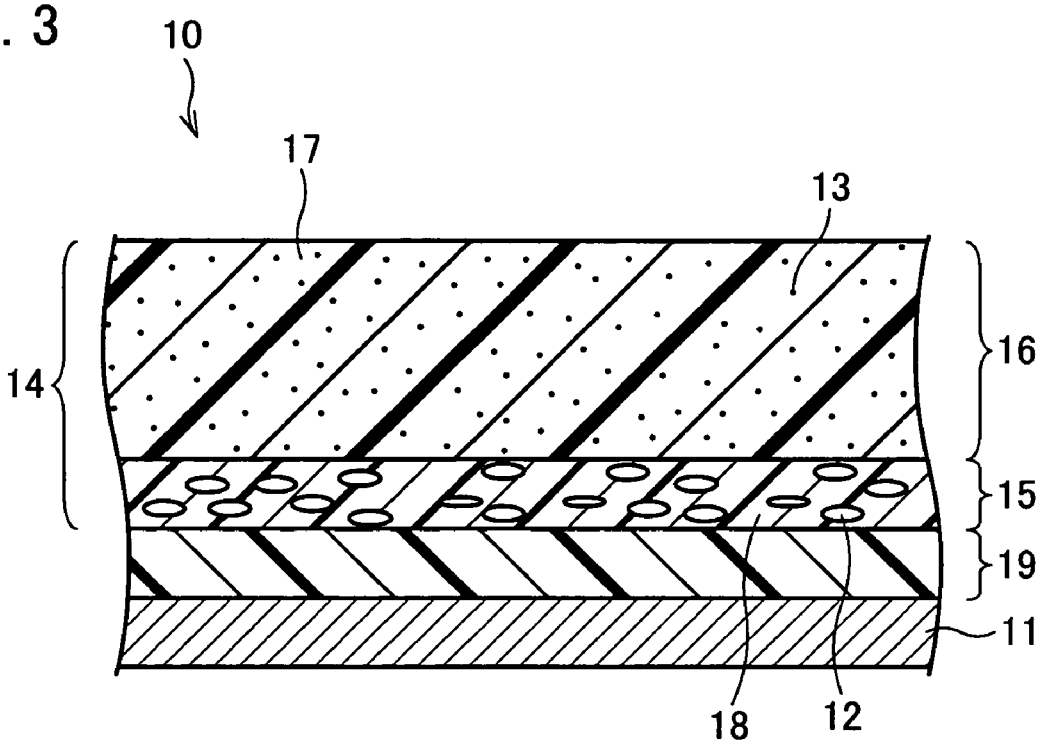
FIG. 3 is a cross-sectional view of a part of another embodiment of the electrophotographic photoreceptor.

The following will describe an embodiment of the present invention with reference to FIG. 1 through FIG. 3. FIG. 1(*a*) is a perspective view of an electrophotographic photoreceptor (hereinafter, "photoreceptor") 10 in accordance with the present embodiment. FIG. 1(*b*) is a cross-sectional view of a part of the photoreceptor 1. FIG. 2 is a schematic side view of an image forming device 2, in accordance with the present embodiment, incorporating the photoreceptor 1.

The photoreceptor 1 is provided in the image forming device 2 as shown in FIG. 2. The photoreceptor 1 is driven by drive means (not shown) to rotate in a direction indicated by arrow R at a predetermined rotational speed. As the photoreceptor 1 rotates, an electrostatic latent image is formed on the surface of the photoreceptor 1 and then rendered visible. As shown in FIG. 1(*a*), the photoreceptor 1 has a drum shape and includes a conductive support 11 and photosensitive layer 14 on the surface of the conductive support 11.

The conductive support 11 is made of electrically conductive material. The conductive material may be, for example, metals, such as aluminum, copper, brass, zinc, nickel, stainless steel, chromium, molybdenum, vanadium, indium, titanium, gold, and platinum; or alloys of these metals. Aluminum, an aluminum alloy, tin oxide, gold, or indium oxide, among others, may be vapor deposited or applied to a polyester film, paper, or metal film. Alternatively, the conductive material may be plastic or paper containing conductive particles; or plastic containing a conductive polymer. These conductive materials are used after being processed into a cylindrical, columnar, or thin film shape.

The photosensitive layer 14 includes a charge generating layer 15 and a charge transporting layer 16 stacked in this order on the conductive support 11. The charge generating layer 15 produce electric charges when exposed. To achieve this effect, the charge generating layer 15 contains a charge generating substance 12 for producing electric charges upon absorption of light, and a binder resin 18 for binding the charge generating substance 12 (hereinafter, "binder resin for a charge generating layer") as shown in FIG. 1(*b*). The charge transporting layer 16 receives the electric charges generated in the charge generating layer 15 and transports the electric charges to the surface of the photoreceptor 1. Thus, electric charges are cancelled in the exposed part on the surface of the photoreceptor 1 to form an electrostatic latent image. Accordingly, still referring to FIG. 1(*b*), the charge transporting layer 16 contains a charge transporting substance 13 for transporting electric charges, and a binder resin 17 ("binder resin for a charge transporting layer") for binding the charge transporting substance 13.

The photosensitive layer 14 exhibits a carrier (electric charge) mobility of $2\times10^{-6}$ $cm^2/(V\cdot s)$ or greater, preferably $3\times10^{-6}$ $cm^2/(V\cdot s)$ or greater at an electric field intensity E of $1\times10^5$ V/cm, so that electric charges are cancelled quickly in the exposed part of the surface (hereinafter, "exposed area") even under low potential conditions. Further, in an electric field intensity E [V/cm] of $5\times10^4$ V/cm<E<$1\times10^5$ V/cm, the logarithm of the carrier mobility in the photosensitive layer 14 is given by equation 1:

$$\log \mu = a\times\sqrt{E}+b \quad \text{(Eq.1)}$$

where μ is the carrier mobility [$cm^2/(V\cdot s)$] of the photosensitive layer 14, and a and b are real numbers. The slope a is $5\times10^{-4}$ or less, preferably $3\times10^{-4}$ or less.

In this manner, the carrier mobility in the photosensitive layer 14 of the photoreceptor 1 is specified by the carrier mobility at the $1\times10^5$ V/cm electric field intensity, and the slope a in equation 1 at the electric field intensity of $5\times10^4$<E<$1\times10^5$. With the carrier mobility specified in relation to the electric field intensity E, the electric charges in the exposed area of the surface can be quickly cancelled even under low potential conditions below these electric field intensities.

In other words, generally, the carrier mobility is measured and determined by TOF (Time of Flight), X-TOF (Xerographic Time of Flight), or a like method. To specify the carrier mobility in the photosensitive layer 14, a carrier mobility at a desired electric field intensity should be measured. However, measuring a carrier mobility by TOF, X-TOF, and like methods under low potential conditions produces much noise, which makes it difficult to accurately measure a carrier mobility. Therefore, in the present embodiment, the carrier mobility in the photosensitive layer 14 at an electric field intensity E is given by equation 1 above, and the carrier mobility in the photosensitive layer 14 for low potential conditions is predicted based on this equation.

That is, in the present embodiment, to specify the carrier mobility in the photosensitive layer 14 for low potential conditions, as mentioned earlier, the carrier mobility at an electric field intensity of $1\times10^5$ V/cm is specified, and the slope a in equation 1 at the electric field intensity of $5\times10^4<E<1\times10^5$ is specified. In this manner, using TOF, X-TOF, or other methods, a carrier mobility is determined in an electric field range that allows for accurate measurement of carrier mobility. Then, based on the carrier mobility so obtained, the carrier mobility in the photosensitive layer 14 for low potential conditions is specified. Therefore, the carrier mobility in the photosensitive layer 14 can be predicted and specified even when the photoreceptor 1 is used under low potential conditions, where actual measurement by TOF, X-TOF, and other methods is difficult.

The photoreceptor 1, as mentioned earlier, is formed so that the carrier (electric charge) mobility in the photosensitive layer 14 at an electric field intensity E of $1\times10^5$ V/cm is $2\times10^{-6}$ $cm^2/(V\cdot s)$ or greater, and that the slope a in equation 1 is $5\times10^{-4}$ or less in a range of $5\times10^4<E<1\times10^5$. Thus, in the image forming device 2, the potential in the exposed area on the surface of the photoreceptor 1 can be cancelled to fall below the development bias before the exposed surface of the photoreceptor 1 reaches the position where the electrostatic latent image formed thereon is developed.

By thus specifying the carrier mobility in the photosensitive layer 14, a sufficient electric potential contrast can be ensured between the exposed area and the non-exposed part (hereinafter, "non-exposed area") on the surface of the photoreceptor 1. Therefore, when an image forming process is carried out with an image forming device 2 (FIG. 2) incorporating the photoreceptor 1, the toner image transferred onto transfer paper has a good image density, and a white background can be prevented from appearing gray, etc.

Further, the electric charge on the surface of the photoreceptor 1 can be quickly cancelled even when there is little time to start the development of the electrostatic latent image after the exposure process for the photoreceptor 1, for example, as in a high speed image forming process by an image forming device 2 or an image forming process by the compact photoreceptor 1. Therefore, image forming processes can be carried out at high speed and the image forming device 2 can be reduced in size.

Referring to FIG. 1(*b*), the following will describe the constituents of the photosensitive layer 14 having the carrier mobility and the slope a as in equation 1, namely, the charge transporting layer 16 including the charge transporting substance 13 and the binder resin 17 for a charge transporting layer, and the charge generating layer 15 including the charge generating substance 12 and the binder resin 18 for a charge generating layer.

The charge transporting substance 13 in the charge transporting layer 16 should exhibit an excellent carrier mobility so that the electric charges generated in the charge generating layer 15 are transported in a suitable manner. The charge transporting substance 13 may be, for example, a carbazole derivative, oxazole derivative, oxadiazole derivative, thiazole derivative, thiadiazole derivative, triazole derivative, imidazole derivative, imidazolone derivative, imidazolidine derivative, bisimidazolidine derivative, styryl compound, hydrazone compound, polycyclic aromatic compound, indole derivative, pyrazoline derivative, oxazolone derivative, benzimidazole derivative, quinazoline derivative, benzofuran derivative, acridine derivative, phenazine derivative, amino stilbene derivative, triarylamine derivative, triarylmethane derivative, phenylenediamine derivative, stilbene derivative, and benzidine derivative. In addition, polymers with a main chain or side chain of a structure formed by these compounds may be used. Examples of such polymers are poly(N-vinyl carbazole), poly(l-vinyl pylene), and poly(9-vinyl anthracene).

Further, the charge transporting substance 13 may be an enamine compound having a structure given by following general formula (1).

(1)

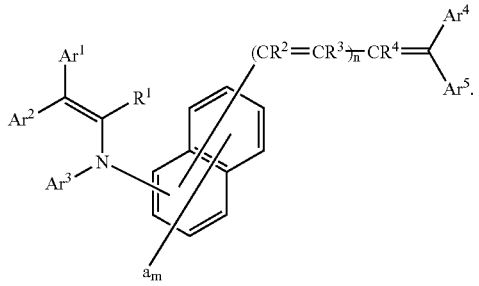

Since the enamine compound has high electric charge mobility, it has high charging capability, sensitivity, and responsiveness. Therefore, even when the photoreceptor 1 is used repeatedly, the electricity characteristics do not deteriorate. Therefore, the enamine compound is especially suitable among different kinds of charge transporting substances 13.

In general formula (1), $Ar^1$ and $Ar^2$ are mutually independent and each of them is either an aryl group which is substituted or unsubstituted, or a heterocyclic group which is substituted or unsubstituted. $Ar^3$ is any one of an aryl group which is substituted or unsubstituted, a heterocyclic group which is substituted or unsubstituted, an aralkyl group which is substituted or unsubstituted, and an alkyl group which is substituted or unsubstituted. $Ar^4$ and $Ar^5$ are mutually independent and each of them is any one of a hydrogen atom, an aryl group which is substituted or unsubstituted, a heterocyclic group which is substituted or unsubstituted, an aralkyl group which is substituted or unsubstituted, and an alkyl group which is substituted or unsubstituted. Not both $Ar^4$ and $Ar^5$ are hydrogen atoms. $Ar^4$ and $Ar^5$ may form a ring structure by bonding each other through an atom or an atomic group.

Further, in general formula (1), indicated by a is any one of an alkyl group which is substituted or unsubstituted, an alkoxy group which is substituted or unsubstituted, a dialkylamino group which is substituted or unsubstituted, an aryl group which is substituted or unsubstituted, a halogen atom, and a hydrogen atom. Indicated by m is an integer from 1 to 6. When $m\geqq2$, the moieties indicated by a may be either identical or different, or bond with each other to form a ring structure.

$R^1$ is any one of a hydrogen atom, a halogen atom, and an alkyl group which is substituted or unsubstituted. $R^2$, $R^3$ and $R^4$ are mutually independent and each of them is any one of a hydrogen atom, an alkyl group which is substituted or unsubstituted, an aryl group which is substituted or unsubstituted, a heterocyclic group which is substituted or unsubstituted, and an aralkyl group which is substituted or unsubstituted. Indicated by n is an integer from 0 to 3. When n=2 or n=3, the moieties indicated by $R^2$ may be either identical or different, and the moieties indicated by $R^3$ may be either identical or different. When n=0, $Ar^3$ is a heterocyclic group which is substituted or unsubstituted.

In general formula (1), aryl groups indicated by $Ar^1$, $Ar^2$, $Ar^3$, $Ar^4$, $Ar^5$, a, $R^2$, $R^3$, and $R^4$ are independently phenyl group, naphthyl group, pyrenyl group, and antrile group, for example. Examples of substituents in these aryl groups are alkyl groups such as a methyl group, an ethyl group, a propyl group, and a trifluoromethyl group; alkenyl groups such as a 2-propenyl group and a styryl group; alkoxy groups such as a methoxy group, an ethoxy group, and a propoxy group; amino groups such as a methylamino group and a dimethylamino group; halogen groups such as a fluoro group, a chloro group, and a bromo group; aryl groups such as a phenyl group and a naphthyl group; aryloxy groups such as a phenoxy group; and arylthio groups such as titaphenoxy groups. Aryl groups containing these substituents are, for example, a tolyl group, a methoxyphenyl group, a biphenylyl group, a terphenyl group, a phenoxyphenyl group, a p-(phenylthio)phenyl group, and a p-styrylphenyl group.

In general formula (1), concrete examples of heterocyclic groups indicated by $Ar^1$, $Ar^2$, $Ar^3$, $Ar^4$, $Ar^5$, $R^2$, $R^3$, and $R^4$ are independently furilic group, thienyl group, thiazolyl group, benzofurilic group, benzothiophenyl group, benzothiazolyl group, and benzoxazolyl group. These heterocyclic groups may be substituted by substituents similar to those in the aryl groups indicated, for example, by $Ar^1$. Examples of heterocyclic groups with a substituent are an N-methylindolyl group and an N-ethyl carbazolyl.

In general formula (1), examples of aralkyl groups indicated by $Ar^3$, $Ar^4$, $Ar^5$, $R^2$, $R^3$ and $R^4$ are independently a benzyl group and 1-naphthylmethyl group. The aralkyl groups may be substituted by, for example, substituents similar to those in the aryl groups indicated, for example, by $Ar^1$. An example of an aralkyl group with a substituent is a p-methoxybenzyl group.

In general formula (1), the alkyl groups indicated by $Ar^3$, $Ar^4$, $Ar^5$, a, $R^1$, $R^2$, $R^3$, and $R^4$ are preferably those containing 1 to 6 carbon atoms. Examples of the alkyl groups are independently chain alkyl groups such as a methyl group, an ethyl group, a n-propyl group, an isopropyl group, a t-butyl group; and cycloalkyl groups such as a cyclohexyl group, and a cyclopentyl group. These alkyl groups may be substituted by, for example, substituents similar to those in the aryl groups indicated, for example, by $Ar^1$. Examples of alkyl groups with a substituent are alkyl groups substituted by a halogenated alkyl group, such as a trifluoromethyl group and a fluoromethyl group; alkoxyalkyl groups such as a 1-methoxyethyl group; and heterocyclic groups such as a 2-thienylmethyl group.

In general formula (1), the alkoxy groups indicated by a preferably contain 1 to 4 carbon atoms and are, for example, a methoxy group, an ethoxy group, an n-propoxy group, or an isopropoxy group. These alkoxy groups may be substituted, for example, by substituents similar to those in the aryl groups indicated, for example, by $Ar^1$.

In general formula (1), the dialkylamino groups indicated by a are preferably those substituted by an alkyl group containing 1 to 4 carbon atoms. The dialkylamino group is, for example, a methylamino group, a diethylamino group, and a diisopropylamino group. These dialkylamino groups may be substituted, for example, by substituents similar to those in the aryl groups indicated, for example, by $Ar^1$.

In general formula (1), the halogen atom indicated by a or $R^1$ is independently a fluorine atom or a chlorine atom, for example.

In general formula (1), the atom bonding $Ar^4$ and $Ar^5$ is, for example, an oxygen atom, a sulfur atom, and a nitrogen atom. For example, with the nitrogen atom in a bivalent group, such as an imino group or an N-alkylimino group, $Ar^4$ and $Ar^5$ can be bonded to each other. The atomic group bonding $Ar^4$ and $Ar^5$ may be a bivalent group, examples of which include an alkylene group such as a methylene group, an ethylene group, or an methylmethylene group; an alkenylene group such as a vinylene group or a lopenylene group; an alkylene group containing a hetero atom, such as an oxymethylene ("—O—$CH_2$—") group; and an alkenylene group containing a hetero atom, such as a thio vinylene ("—S—CH═CH—") group.

For ease of binding, the charge transporting layer 16 contains the binder resin 17 for a charge transporting layer. The binder resin 17 for a charge transporting layer is preferably highly compatible with the charge transporting substance 13. Specific examples of the resin 17 include vinyl polymer resins such as a polymethyl methacrylate resin, a polystyrene resin, and a polyvinylchloride resin, and copolymer resins of these resins; a polycarbonate resin; a polyester resin; a polyester carbonate resin; a polysulfonic resin; a phenoxy resin; an epoxy resin; a silicone resin; a polyarylate resin; a polyamide resin; a polyether resin; a polyurethane resin; a polyacrylamide resin; and a phenol resin. These resins may be partially crosslinked to give thermosetting resins for use. These resins may be used alone or in combination of two or more kinds.

Among these resins, the polystyrene resin, polycarbonate resin, polyarylate resin, and polyphenylene oxide are suitable as the binder resin 17 for a charge transporting layer. This is because these resins provide excellent electrical insulation with a volume resistivity of $10^{13}$ Ω or greater, and are superior in coating and electric potential characteristics.

The charge transporting substance 13 and the binder resin 17 for a charge transporting layer should be contained in the charge transporting layer 16 in such proportions that at least 1.2 parts by weight, or preferably at least 1.6 parts by weight of the binder resin 17 is contained for 1 part by weight of the charge transporting substance 13, and that at most 3 parts by weight, or preferably at most 2.3 parts by weight of the binder resin 17 for a charge transporting layer is contained for 1 part by weight of the charge transporting substance 13.

If the content of the binder resin 17 for a charge transporting layer is less than 1.2 parts by weight with respect to 1 part by weight of the charge transporting substance 13, the photosensitive layer 14 becomes less resistant to abrasion and wears quickly. In contrast, if the content of the binder resin 17 for a charge transporting layer exceeds 3 parts by weight with respect to 1 part by weight of the charge transporting substance 13, the viscosity of a coating liquid used in the formation of the charge transporting layer 16 by dip coating or similar coating methods (detailed later) increases. The increased viscosity makes it difficult to form the layer, greatly cutting down productivity. Increasing the amount of solvents in the coating liquid to restrain an increase of viscosity of the coating liquid is not preferable, because doing so causes the charge transporting layer 16 to cloud due to a brushing phenomenon.

The charge transporting layer 16 may contain substances other than the charge transporting substance 13 and the binder resin 17 for a charge transporting layer. Specifically, these substances are additives, such as plasticizers and leveling agents, which impart improved film forming properties, flexibility, and surface smoothness to the charge transporting layer 16; fine particles of inorganic and organic compounds aimed at improving the mechanical strength and electric properties of the charge transporting layer 16; antioxidants and sensitizers aimed at improving the electric potential property and durability of the charge transporting layer 16. These substances may be contained in the charge transporting layer 16 either alone or in combination of two or more kinds.

In addition, to improve sensitivity of the photosensitive layer 14, or restrain increase in residual electric potential, or fatigue, etc. in repeated use of the photoreceptor 1, the charge transporting layer 16 may further contain electron accepting substances such as electron attracting materials; and functional pigments, such as organic photoconducting compounds or optical sensitizers.

The thickness of the charge transporting layer 16 is preferably 5 μm or more, more preferably 10 μm or more. The maximum thickness of the charge transporting layer 16 is preferably 50 μm or less, more preferably 40 μm or less. The charge transporting layer 16 thinner than 5 μm is not preferable, because the surface of the photoreceptor 1 does not hold as much charges. The charge transporting layer 16 thicker than 50 μm is not preferable, because the resolution of the photoreceptor 1 degrades.

The charge generating substance 12 in the charge generating layer 15 produces electric charges when exposed. Examples of the charge generating substance 12 include: perylene pigments such as perylene imide, or anhydrides of perylene acid; polycyclic quinone pigments such as quinacridone or anthraquinone; phthalocyanine pigments such as metallic phthalocyanine, metal-free phthalocyanine, or halogenated metal-free phthalocyanine; pigment compounds such as a squarate pigment, an azulenium pigment, or a thiapyrylium pigment; and azo pigments having a carbazole unit, a styrylstilbene unit, a triphenylamine unit, a dibenzothiophene unit, an oxadiazole unit, a fluorenon unit, a bisstilbene unit, a distyryloxadiazole unit, or a distyrylcarbazole unit.

Among these charge generating substances 12, those pigments with a high electric charge generating ability are especially preferred: metal-free phthalocyanine pigments, titanyl phthalocyanine pigment, bisazo pigments with a florene ring and a fluorenon ring, bisazo pigments made from aromatic amine, and trisazo pigments. Using these pigments allows the photoreceptor 14 to have high sensitivity. Especially preferred among titanyl phthalocyanine pigments are those of a crystal type exhibiting a diffraction peak at a Bragg angle of 27.3° (2θ±0.2°) in an x-ray diffraction spectrum of a CuKα characteristic x-ray.

To enhance binding properties, the charge generating layer 5 may contain a binder resin 18 for a charge generating layer. The binder resin 18 for a charge generating layer is, for example, a polyester resin, a polyvinyl acetate resin, a polyacrylic ester resin, a polycarbonate resin, a polyarylate resin, a polyvinyl acetoacetal resin, a polyvinyl propional resin, a polyvinyl butyral resin, a phenoxy resin, an epoxy resin, a urethane resin, a melamine resin, a silicone resin, an acrylic resin, a cellulose ester, a cellulose ether, or a vinyl chloride-vinyl acetate copolymer resin.

The charge generating substance 12 and the binder resin 18 for a charge generating layer should be contained in the charge generating layer 15 in such proportions that preferably at least 10 percent by weight, or more preferably at least 25 percent by weight of the charge generating substance 12 is contained with respect to a total weight of the charge generating substance 12 and the binder resin 18 for a charge generating layer, and that preferably at most 99 percent by weight, or more preferably at most 75 percent by weight of the charge generating substance 12 is contained with respect to a total weight of the charge generating substance 12 and the binder resin 18 for a charge generating layer.

If the content of the charge generating substance 12 is less than 10 percent by weight with respect to the total weight of the charge generating substance 12 and the binder resin 18 for a charge generating layer, the photosensitive layer 14 of the photoreceptor 1 shows poor sensitivity, which is not desirable. In contrast, if the content of the charge generating substance 12 exceeds 99 percent by weight with respect to the total weight of the charge generating substance 12 and the binder resin 18 for a charge generating layer, the film strength of the charge generating layer 15 decreases, which is not desirable. Further, if the content of the charge generating substance 12 exceeds 99 percent by weight, dispersibility of the charge generating substance 12 decreases, with the result that the particles of the charge generating substance 12 easily grow into coarse particles. As a result, toner (developer) is likely to adhere to the white background of transfer paper on which an image is formed, leaving tiny black points (fogging).

The charge generating layer 15 may contain, where necessary, a leveling agent for improving the coating ability of the coating liquid used in forming the charge generating layer 5. The charge generating layer 15 may also contain, where necessary, other additives such as a plasticizer, antioxidant, or sensitizer.

The minimum thickness of the charge generating layer 15 is preferably 0.05 μm or more, more preferably 0.1 μm or more. In addition, the maximum thickness of the charge transporting layer 16 is preferably 5 μm or less, more preferably 1 μm or less. A thickness of the charge generating layer 15 less than 0.05 μm is not preferable because it reduces the efficiency of light absorption and thereby reduces sensitivity of the photosensitive layer 14. In contrast, if the thickness exceeds 5 μm, the carrier movement inside the charge generating layer 15 determines the rate of canceling the surface charge of the photoreceptor 14, which undesirably reduces the sensitivity of the photosensitive layer 14.

Next, a method of forming the photosensitive layer 14 will be described. The photosensitive layer 14, as shown in FIG. 1(*b*), is formed by forming the charge generating layer 15 on the conductive support 11, and the charge transporting layer 16 on the charge generating layer 15.

Specifically, the charge generating layer 15 is formed as follows: First, a charge-generating-layer coating liquid is obtained by dispersing the charge generating substance 12 in a solution of the binder resin for a charge generating layer, prepared by mixing the binder resin 18 for a charge generating layer in an appropriate solvent. Thereafter, the resultant coating liquid for the charge generating layer is applied onto the conductive support 11 to form the charge generating layer 15 on the conductive support 11. Like the charge generating layer 15, the charge transporting layer 16 is formed in a similar fashion: First, the binder resin 17 for a charge transporting layer, the charge transporting substance 13, and optionally an additive(s) are dissolved or dispersed in an appropriate solvent to prepare a coating liquid for the charge transporting layer. Thereafter, the resultant coating liquid for the charge transporting layer is applied onto the charge generating layer 15 to form the charge transporting layer 16.

The solvent used to prepare the coating liquid for the charge generating layer, and the coating liquid for the charge transporting layer is, for example, halogenated hydrocarbons, such as dichloromethane and dichloroethane; ketones such as acetone, methylethylketone, or cyclohexanone; esters such as ethyl acetate or butyl acetate; ethers such as tetrahydrofuran (THF) or dioxane; alkyl ethers of ethylene glycol, such as 1,2-dimethoxyethane; aromatic hydrocarbons such as benzene, toluene, xylene, or monochlorbenzene; and aprotic polarity solvents such as N,N-dimethyl formamide or N,N-dimethyl acetoamide. These solvents may be used either alone or in combination of two or more kinds. In addition, if necessary, an alcohol or acetonitrile may be added to the solvent.

Before dispersing the charge generating substance 12 or the charge transporting substance 13 in the solvent, the charge generating substance 12 or the charge transporting substance 13 may be pulverized with a pulverizer, etc. in advance. The pulverizer may be, for example, a ball mill, sand grinder, attritor, or vibration mill.

In addition, the dispersing machine used in dispersing the charge generating substance 12 and the charge transporting substance 13 may be a paint shaker, ball mill, sand mill, or ultrasonic disperser. In dispersion, it is preferable that impurities be prevented from contaminating the dispersion system, which may occur when a container or members of the dispersing machine are worn out, for example.

Further, the coating liquid for the charge generating layer, or the coating liquid for the charge transporting layer may be applied by a spraying method, a vertical ring method, or a dip coating method, if the conductive support 11 has a drum-like shape. Among these methods, an optimal application method is selected, taking into consideration properties of the coating liquid for the charge generating layer, productivity of the photoreceptor 1, and other factors. Among these methods, the dip coating method enables the charge generating layer 15 or charge transporting layer 16 to be formed in a relatively simple manner by immersing the conductive support 11 in a coating tank filled with the coating liquid for the charge generating layer or charge transporting layer, and then by pulling up the conductive support 11 at a constant speed or varying speeds. Therefore, the dip coating method is excellent in terms of productivity and manufacturing cost. The method is therefore suitable for use in the forming of the charge generating layer 15 and the charge transporting layer 16.

Besides these methods, the charge generating layer 15 and the charge transporting layer 16 may be formed by vacuum deposition. Especially, when the conductive support 11 is in a sheet-like shape, it is preferable to form the charge generating layer 15 and the charge transporting layer 16 using a baker applicator, or by bar coating, casting, roll coating, blading, or spin coating, among other methods.

In addition, on the photosensitive layer 14 including the charge generating layer 15 and the charge transporting layer 16, a protective layer may be formed with a resin, an inorganic-filler-containing resin, an inorganic oxide, etc. The provision of the protective layer improves the resistance of the photosensitive layer 14 to abrasion. The provision of the protective layer also prevents the photosensitive layer 14 from being adversely affected by ozone, nitrogen oxides, or other contaminants produced in corona discharge which charges the surface of the photoreceptor 1.

As mentioned earlier, as shown in FIG. 1(*b*), the photoreceptor 1 contains the charge generating layer 15 and the charge transporting layer 16. Alternatively, as shown in FIG. 3, an intermediate layer 19 may be provided between the conductive support 11 and the photosensitive layer 14. FIG. 3 is a cross-sectional view of a part of a photoreceptor 10 containing the photosensitive layer 14 and the intermediate layer 19.

As shown in FIG. 3, the intermediate layer 19 in the photoreceptor 10 is provided to cover defects, such as irregularities on the surface of the conductive support 11 and thereby obtain a level surface. This improves the film forming properties of the photosensitive layer 14 and improves the adhesion between the conductive support 11 and the photosensitive 14 via the intermediate layer 19, thereby restraining the photosensitive 14 from detaching from the conductive support 11. For desirable functionality, it is generally preferable that the intermediate layer 19 be formed within a thickness range of 0.1 μm to 20 μm, inclusive.

It is preferable that the intermediate layer 19 be either an inorganic layer containing an inorganic substance as a major component, or an organic layer containing an organic substance as a major component. When the intermediate layer 19 is an inorganic layer, the inorganic substance may be, for example, an aluminum anodic oxide coating film, aluminum oxide, or aluminum hydroxide. To form the inorganic layer, an oxide coating film is formed by applying an electric field to the aluminum conductive support 11 in a sulfuric acid solution.

On the other hand, when the intermediate layer 19 is an organic layer, the organic substance to be a binder resin may be, for example, polyvinyl alcohol, casein, polyvinylpyrrolidone, polyacrylic acid, a cellulose, gelatin, starch, polyurethane, polyimide, or polyamide. The organic layer may contain inorganic pigments such as conductive or semiconducting fine particles, which may be metal such as aluminum, copper, tin, zinc, or titanium; or metal oxide such as zinc oxide, aluminum oxide, or titanium oxide. The titanium oxide contained in the organic layer may be of any crystal form including anatase, rutile, and amorphous. Further, the titanium oxide may take two or more different crystal forms. In addition, it is preferable that the titanium oxide particles are used with their surface covered with, for example, a metal oxide, such as $Al_2O_3$ and $ZrO_2$, or a mixture of these metal oxides.

Among these resins, the binder resin used for the intermediate layer 19 (binder resin for an intermediate layer) is preferably a polyamide resin. This is because the polyamide resin will not be dissolved or swelled by the solvent used for the coating liquid for the charge generating layer to form the charge generating layer 15, one of the photosensitive layer 14, on the intermediate layer 19. In addition, the polyamide resin shows excellent adhesion with the conductive support 11 and is flexible. These are desirable properties and among the properties required for the binder resin.

Among the polyamide resins, an alcohol-soluble nylon resin is preferred for use. The alcohol-soluble nylon resin is, for example, a so-called copolymerization nylon prepared by the copolymerization of 6-nylon, 66-nylon, 610-nylon, 11-nylon, 12-nylon, etc.; or a chemically denatured nylon, such as N-alkoxymethyl denatured nylon or N-alkoxyethyl denatured nylon.

The organic layer is formed by applying onto the conductive support 11 the coating liquid for the intermediate layer, wherein the coating liquid for the intermediate layer is prepared by adding an organic solvent and a binder resin for an intermediate layer to the material for the foregoing organic layer, and adjusted by using a dispersing machine, etc.

The organic solvent used for the coating liquid for the intermediate layer may be a common organic solvent. Among them, when an alcohol-soluble nylon resin, which is a polyamide resin, is used as the binder resin for an intermediate layer, it is preferable that the organic solvent be a lower alcohol containing 1 to 4 carbon atoms, or a mixture of two or more kinds of lower alcohols containing 1 to 4 carbon atoms, or be a mixture of organic solvents prepared by mixing such a lower alcohol organic solvent with an organic solvent selected from a group of non-lower alcohols such as dichloromethane, chloroform, 1,2-dichloroethane, 1,2-dichloropropane, toluene, THF, and 1,3-dioxolane.

In this manner, the mixing of the lower alcohol organic solvent with the non-lower alcohol organic solvent improves dispersibility of the titanium oxide, maintains the preservability of the coating liquid for the intermediate layer for an extended time period, and enables reproduction of the coating liquid, when compared with using the lower alcohol organic solvent alone. In addition, with the use of the dip coating method in which the intermediate layer 19 is formed by immersing the conductive support 1 in the coating liquid for the intermediate layer, the intermediate layer 19 can be formed without defect or non-uniformity, enabling the photosensitive layer 14 to be evenly applied on the intermediate layer 19. Thus, the photoreceptor 10 exhibiting excellent image characteristics can be made with no film defects.

The coating liquid for the intermediate layer may be applied by any other method than the dip coating. In other words, when the conductive support 11 is in a drum-like shape, a spraying, vertical ring, or like method can be used. When the conductive support 11 is in a sheet-like shape, a baker applicator, bar coater, casting, spin coating, or like method can be used.

Next, referring to FIG. 2, the image forming device 2 will be described. The image forming device 2 contains either the photoreceptor 1 shown in FIG. 1 or the photoreceptor 10 shown in FIG. 3. In the following, assume as an example that the image forming device 2 contains the photoreceptor 1 shown in FIG. 2. The same description applies to the image forming device 2 containing the photoreceptor 10 shown in FIG. 3.

The image forming device 2 includes, around the photoreceptor 1, an electric charging device 32, exposure means 30, a developer 33, a transfer device 34, separator means 37, and a cleaner 36 arranged in this order in a direction R of rotation of the photoreceptor 1. The photoreceptor 1, electric charging device 32, developer 33, separator means 37, and cleaner 36 are all contained in a housing 38. In addition, the image forming device 2 has a fuser 35 in a direction P of transport of transfer paper 45.

The electric charging device 32 is, for example, an electric charger and uniformly charges the surface of the photoreceptor 1 by being powered by an external power supply 39. The exposure means 30 is realized by a semiconductor laser, for example. The exposure means 30 exposes the surface of the photoreceptor 1 with a laser beam from the semiconductor laser to form an electrostatic latent image. The developer 33 feeds toner (developer) to develop the electrostatic latent image formed on the surface of the photoreceptor 1 by the exposure by the exposure means 30. To this end, the developer 33 is equipped with a development roller 33*a* in a casing 33*b*. With the development roller 33*a*, the toner stirred in the casing 33*b* is fed to the surface of the photoreceptor 1. The toner used in the developer 33 may be a single-component toner, or a two-component toner including a carrier.

The transfer device 34 is positioned to come in contact with the photoreceptor 1 via the transfer paper 45. The transfer device 34 is powered by an external power supply 40 to transfer the toner image formed on the surface of the photoreceptor 1 onto the transfer paper 45. The separator means 37 is provided to detach the transfer paper from the surface of the photoreceptor 1. The cleaner 36 is provided to collect residual toner remaining on the surface of the photoreceptor 1. In other words, the cleaner 36, with a cleaning blade 36*a*, scrapes the residual toner adhering to the surface of the photoreceptor 1, and collects the toner in a collection casing 36*b*. With the fuser 35, the transfer paper 45 carrying a toner image transferred by the transfer device 34 is transported between a heating roller 35*a* and a press roller 35*b*, where the fuser 35 melts and presses the toner image under heat so that the image is fused onto the transfer paper 45.

An image forming process is carried out as follows in the image forming device 2 arranged as in the foregoing. As the image forming device 2 receives a request to form an image based on predetermined image data, the electric charging device 32 uniformly charges the photoreceptor surface to a predetermined potential. Next, the laser beam emitted from the exposure means 30 exposes the surface of the photoreceptor 1 according to the image data, so as to form an electrostatic latent image on the surface of the photoreceptor 1 according to the image data. The electrostatic latent image is visualized gradually by the developer 33 disposed downstream of the exposure means 30 in the direction R of rotation of the photoreceptor 1. As a result, a toner image is formed on the surface of the photoreceptor 1.

Simultaneously with the exposure of the surface of the photoreceptor 1, the transfer paper 45 is transported between the photoreceptor 1 and the transfer device 34 in the direction indicated by arrow P in FIG. 2. Thus, as the photoreceptor 1 rotates and the transfer paper 45 is transported, the toner image on the surface of the photoreceptor 1 is gradually transferred onto the transfer paper 45. Subsequently, the transfer paper 45 with the transferred toner image is transported to the fuser 35 where the toner image is fused onto the transfer paper 45. The transfer paper 45 with the fused toner image is ejected out of the image forming device 2.

Meanwhile, after the transfer of the toner image, the residual toner on the surface of the photoreceptor 1 is removed as the photoreceptor 1 rotates and the cleaning blade 36*a* scrapes off the toner. Thereafter, with another rotation of the photoreceptor 1, the image forming process is repeated to form another image on the transfer paper 45.

The image forming device 2 contains the photoreceptor 1 discussed above. Therefore, after the exposure by the exposure means 30, the electric charges generated by the photosensitive layer 14 of the photoreceptor 1 move quickly to the surface of the photoreceptor 1, even under low potential development conditions, to cancel the surface electric charges. This is completed before the developer 33 starts development. Therefore, the image forming process can form an image with good image density on the transfer paper 45.

Further, the use of the photoreceptor 1 can ensure a predetermined carrier mobility, and, in addition, set the potential of the charged photoreceptor 1 as low as 400 V or even less in absolute value. This restrains electrostatic fatigue caused by the charging of the photoreceptor 1, and extends the life of the photoreceptor 1. Further, if toner of small particle diameters is used to develop at a low potential, only a small amount of toner would be required to form an image with a desired image density at high resolution. Therefore, the use of the photoreceptor 1 can provide a low-cost image forming device.

The weight average particle diameter of the toner greatly affects image quality. In the present embodiment, it is preferable that the weight average particle diameter of the toner be from 4.5 μm to 8.5 μm, inclusive. If the weight average particle diameter of the toner is less than 4.5 μm, there are too many charges per unit mass, which tends to hamper the development of the electrostatic latent image and may result in insufficient image density. In contrast, if the weight average particle diameter of the toner exceeds 8.5 μm, it becomes difficult to faithfully reproduce the electrostatic latent image, with the result that a coarse image is produced. Therefore, the toner used here has a small particle diameter and contains a large amount of coloring agent such as carbon black, which exhibits a lower electric resistance and charges to a lower potential than resins and like substances, so that the toner is charged to a suitable value. Thus, the toner contains an increased amount of coloring agent, providing sufficient image density with a small amount of toner. In addition, the amount of toner used per transfer paper can be reduced, enabling images to be formed at low cost.

An electrophotographic photoreceptor in accordance with the present invention, as described earlier, is an electrophotographic photoreceptor including a photosensitive layer on a conductive support, the photosensitive layer containing at least a charge generating substance and a charge transporting substance, a mobility of electric charges in the photosensitive layer in an electric field having an intensity of $1\times10^5$ V/cm being $2\times10^{-6}$ $cm^2/(V\cdot s)$ or greater, and a slope a in equation 1 being $5\times10^{-4}$ or less:

$$\log \mu = a\times\sqrt{E}+b \qquad \text{(Eq.1)}$$

where μis the mobility, in $cm^2/(V\cdot s)$, of the electric charges in the photosensitive layer at $5\times10^4$ V/cm<E<$1\times10^5$ V/cm, where E is an intensity of an electric field, and a and b are real numbers.

In the electrophotographic photoreceptor in accordance with the present invention, it is preferable that the photosensitive layer have a layer structure including at least a charge generating layer containing the charge generating substance, and a charge transporting layer containing the charge transporting substance.

With the layer structure of the photosensitive layer including a charge generating layer which generates electric charges, and a charge transporting layer which transports the electric charges, the charge can be generated and transported in different layers. The structure gives wider choices for the charge generating substance and the charge transporting substance. An optimum combination is selectable in view of various requirements for the electrophotographic photoreceptor: e.g. the charging characteristics, sensitivity, residual potential, additional life of the electrophotographic photoreceptor. Thus, a high performance electrophotographic photoreceptor can be provided.

In the electrophotographic photoreceptor in accordance with the present invention, it is preferable that the charge transporting layer contain at least the charge transporting substance and a binder resin, and the binder resin is contained in an amount between 1.2 parts by weight and 3 parts by weight, inclusive, with respect to 1 part by weight of the charge transporting substance.

Setting the ratio of the binder resin to the charge transporting substance in the charge transporting layer to a value within the specified range is advantageous in desirably forming the charge transporting layer. In addition, the ratio restrains wearing of the photosensitive layers, and gives the electrophotographic photoreceptor better durability. Therefore, setting the ratio within the specified range ensures a sufficient electric charge mobility in the charge transporting layer, and improves durability of the electrophotographic photoreceptor.

In the electrophotographic photoreceptor in accordance with the present invention, it is preferable that the charge transporting substance have a structure represented by general formula (1):

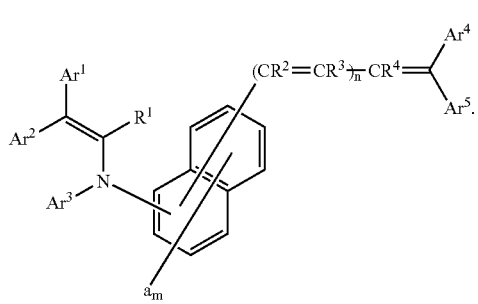

where $Ar^1$ and $Ar^2$ are mutually independent and each of them is either an aryl group which is substituted or unsubstituted, or a heterocyclic group which is substituted or unsubstituted; $Ar^3$ is any one of an aryl group which is substituted or unsubstituted, a heterocyclic group which is substituted or unsubstituted, an aralkyl group which is substituted or unsubstituted, and an alkyl group which is substituted or unsubstituted; $Ar^4$ and $Ar^5$ are mutually independent and each of them is any one of a hydrogen atom, an aryl group which is substituted or unsubstituted, a heterocyclic group which is substituted or unsubstituted, an aralkyl group which is substituted or unsubstituted, and an alkyl group which is substituted or unsubstituted; not both $Ar^4$ and $Ar^5$ are hydrogen atoms; $Ar^4$ and $Ar^5$ may form a ring structure by bonding each other through an atom or an atomic group; the moiety indicated by a is any one of an alkyl group which is substituted or unsubstituted, an alkoxy group which is substituted or unsubstituted, a dialkylamino group which is substituted or unsubstituted, an aryl group which is substituted or unsubstituted, a halogen atom, and a hydrogen atom; m is an integer from 1 to 6; when m≧2, the moieties indicated by a are either identical or different, or bond with each other to form a ring structure; $R^1$ is any one of a hydrogen atom, a halogen atom, and an alkyl group which is substituted or unsubstituted; $R^2$, $R^3$ and $R^4$ are mutually independent and each of them is any one of a hydrogen atom, an alkyl group which is substituted or unsubstituted, an aryl group which is substituted or unsubstituted, a heterocyclic group which is substituted or unsubstituted, and an aralkyl group which is substituted or unsubstituted; n is an integer from 0 to 3; when n=2 or n=3, the moieties indicated by $R^2$ are either identical or different and the moieties indicated by $R^3$ are either identical or different; and when n=0, $Ar^3$ is a heterocyclic group which is substituted or unsubstituted.

The charge transporting substance is a compound having a structure represented by general formula (1); therefore, a charge transporting layer can be formed which exhibits an excellent electric charge mobility even at low electric potentials. In addition, a sufficient electric charge mobility in the charge transporting layer can be ensured even when content of the charge transporting substance in the charge transporting layer is small. The resultant excellent electrophotographic photoreceptor boasts high resolution and high durability.

An image forming device in accordance with the present invention incorporates any one of the foregoing electrophotography photoreceptors.

The image forming device in accordance with the present invention may be adapted to form an image using a developer having a weight average particle diameter of from 4.5 μm to 8.5 μm, inclusive, with the electrophotographic photoreceptor being charged to an electric potential of 400 V or less in absolute value.

EXAMPLES

The following will describe the present invention in detail by way of Examples and Comparative Examples. The description is not limiting the present invention in any way. First, the measurement of carrier mobility, evaluation of image characteristics, and repetition durability test will be explained.

Measurement of Carrier Mobility

The carrier mobility of the photoreceptors prepared in Examples and Comparative Examples were measured at an electric field intensity E of $1\times10^5$ V/cm by a X-TOF method using a drum tester CYNTHIA (available from GENTEC). In addition, the slope a in equation 1 was calculated in an electric field range of $5\times10^4<E<1\times10^5$.

Evaluation of Image Characteristics

The photoreceptors prepared in Examples and Comparative Examples were mounted to a commercially available copying machine (AR-450S, Sharp Co., Ltd.). Images were formed by reverse development using the machine. Image characteristics were evaluated visually. Of development conditions for image formation, normal development conditions were as follows: the electric potential on the surface of the photoreceptor was −650 V, the development bias was −500 V, and the toner used had a weight average particle diameter of 9 μm. Low potential development conditions were as follows: the electric potential on the surface of the photoreceptor was −400 V, the development bias was −200 V, and the toner used had a weight average particle diameter of 6 μm.

Repetition Durability Test

Under the low potential development conditions, a copying process was repeated 100,000 times using A4 transfer paper so as to test the durability of the photoreceptors.

Example 1

Seven parts by weight of titanium oxide (TTO55A, Ishihara Sangyo Co., Ltd.) and 13 parts by weight of a copolymerized nylon resin (Amilan CM8000, Toray Industries, Inc.) were added to a solvent mixture containing 159 parts by weight of methanol and 106 parts by weight of 1,3-dioxolane. The resultant mixture was subjected to a dispersion treatment using a paint shaker for 8 hours, to prepare a coating liquid for an intermediate layer. The resultant coating liquid for an intermediate layer was placed in a coating tank. A cylindrical aluminum conductive support 11 was immersed in the coating tank. The support 11 was 30 mm in diameter and 340 mm in height. The support 11 was pulled out of the coating tank and dried naturally to form an intermediate layer 19 having a thickness of 1 μm (see FIG. 3).

Next, 1 part by weight of a polyvinyl butyral resin (S-LEC BX-1, Sekisui Chemical Co., Ltd.) as the binder resin 18 for a charge generating layer was dissolved in 98 parts by weight of tetrahydrofuran (THF). One part by weight of oxotitanium phthalocyanine as the charge generating substance 12 was also added. The resultant mixture was subjected to a dispersion treatment using a paint shaker for 2 hours, to prepare a coating liquid for a charge generating layer. The support 11 on which the intermediate layer 19 had been formed was immersed in a coating tank filled with the resultant coating liquid for a charge generating layer, so as to apply, onto the intermediate layer 19, the coating liquid for a charge generating layer. The support 11 was then naturally dried to form a charge generating layer 15 having a thickness of 0.3 μm.

Subsequently, 10 parts by weight of an enamine compound having the structure given by chemical formula (2) below, and 18 parts by weight of a bisphenol Z-type polycarbonate resin (Iupilon Z-200, Mitsubishi Engineering Plastics Corporation) were dissolved in 160 parts by weight of THF, to prepare a coating liquid for a charge transporting layer. The enamine compound was added as the charge transporting substance 13, and the bisphenol Z-type polycarbonate resin was added as the binder resin 17 for a charge transporting layer. The support 11 on which the intermediate layer 19 and the charge generating layer 15 had been formed was immersed in a coating tank filled with the resultant coating liquid for a charge transporting layer, thereby dip-coating the charge generating layer 15. The support 11 was then dried to form a charge transporting layer 16 having a thickness of 28 μm. A photoreceptor was thus obtained.

(2)

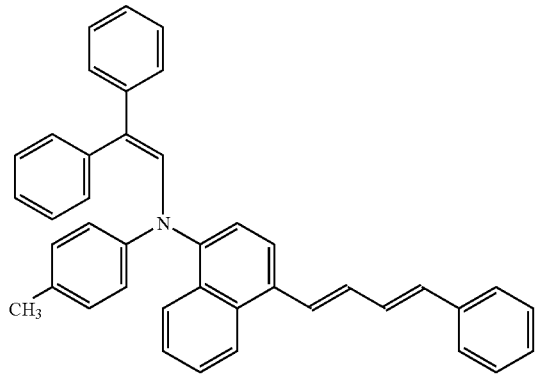

The carrier mobility of the resultant photoreceptor was measured, and the image characteristics of the photoreceptor were evaluated. Results are shown in Table 1. In addition, a repetition durability test was performed on the photoreceptor. Image characteristics after the completion of copying of 100,000 sheets were good.

Examples 2 to 5

In the formation of the charge transporting layer 16, enamine compounds given by following chemical formulae (3) to (6) were respectively used as the charge transporting substance 13, in place of the enamine compound having the structure given by chemical formula (2). Except for this, the procedure of Example 1 was used to form photoreceptors.

(3)

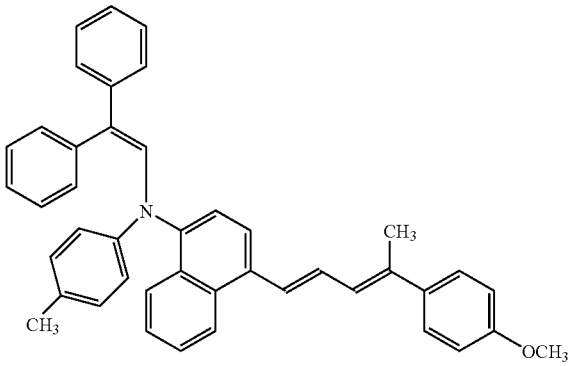

(4)

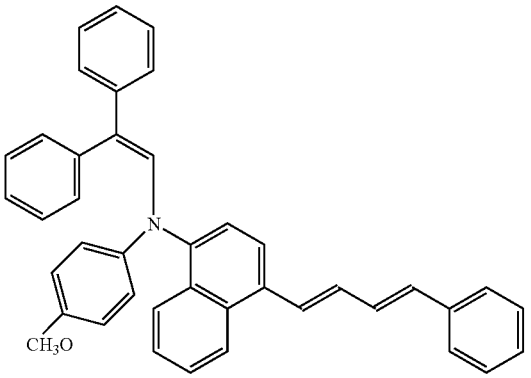

(5)

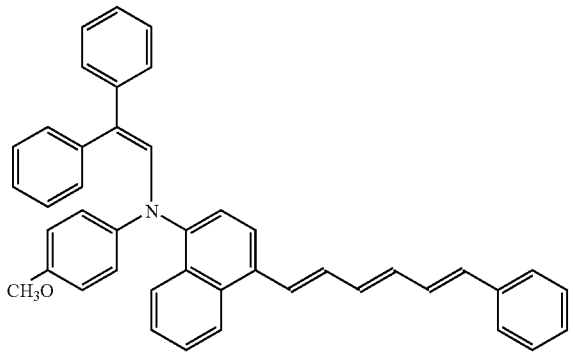

(6)

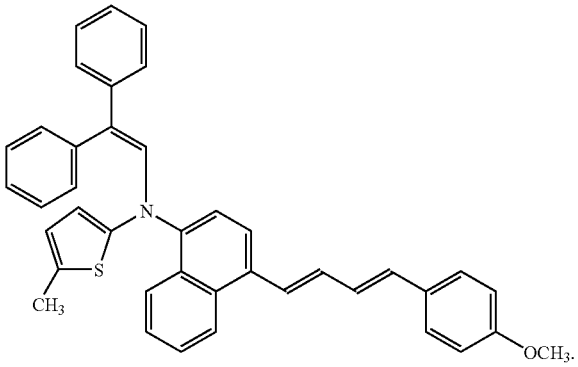

The carrier mobilities of the resultant photoreceptors were measured, and image characteristics of the photoreceptors were evaluated. Results are shown in Table 1.

Example 6

In the formation of the charge transporting layer 16, 14 parts by weight of an enamine compound having a structure given by chemical formula (1) was used as the charge transporting substance 13. Also, 14 parts by weight of the bisphenol Z-type polycarbonate resin was used as the binder resin 17 for a charge transporting layer. Except for this, the procedure of Example 1 was used to form a photoreceptor.

The carrier mobility of the resultant photoreceptor was measured, and image characteristics of the photoreceptors were evaluated. Results are shown in Table 1. In addition, a repetition durability test was performed on the photoreceptors. Image characteristics were evaluated after the completion of copying of 100,000 sheets. The evaluation revealed that fogging occurred.

Comparative Example 1

In the formation of the charge transporting layer 16, 7 parts by weight of an enamine compound having a structure given by chemical formula (1) was used as the charge transporting substance 13. Also, 22 parts by weight of the bisphenol Z-type polycarbonate resin was used as the binder resin 17 for a charge transporting layer. Except for this, the procedure of Example 1 was used to form a photoreceptor.

The carrier mobility of the resultant photoreceptor was measured, and image characteristics of the photoreceptor were evaluated. Results are shown in Table 1.

Comparative Example 2

In the formation of the charge transporting layer 16, 10 parts by weight of a compound (T405, Takasago International Corporation) given by chemical formula (7) below was used as the charge transporting substance 13, in place of the enamine compound having the structure given by chemical formula (2). Also, 16 parts by weight of the bisphenol Z-type polycarbonate resin was used as the binder resin 17 for a charge transporting layer. Except for this, the procedure of Example 1 was used to form a photoreceptor.

(7)

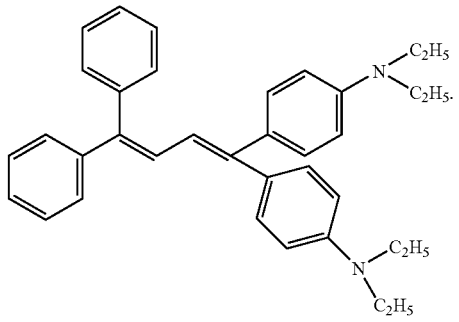

The carrier mobility of the resultant photoreceptor was measured, and image characteristics of the photoreceptor were evaluated. Results are shown in Table 1.

Comparative Example 3

In the formation of the charge transporting layer 16, 10 parts by weight of a compound (HCT202, Hodogaya Chemical Co., Ltd.) given by chemical formula (8) below was used as the charge transporting substance 13, in place of the enamine compound having the structure given by chemical formula (2). Also, 20 parts by weight of the bisphenol Z-type polycarbonate resin was used as the binder resin 17 for a charge transporting layer. Except for this, the procedure of Example 1 was used to form a photoreceptor.

(8)

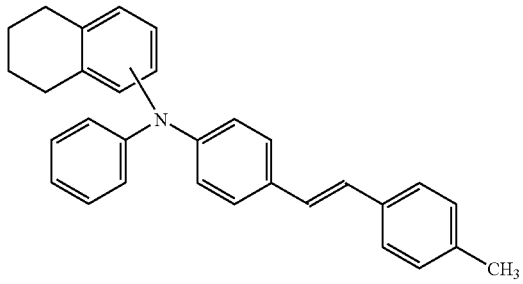

The carrier mobility of the resultant photoreceptor was measured, and image characteristics of the photoreceptor were evaluated. Results are shown in Table 1.

ling the weight ratio of the binder resin for a charge transporting layer to the charge transporting substance improves the resistance to abrasion of the photosensitive layer of the photoreceptor.

Comparative Example 4

Using the photoreceptor of Example 1, an image was developed with toner having a weight average particle diameter of 9 μm, under low potential development conditions. Image characteristics were evaluated. A coarse image was produced.

It is hence understood that in order to form a good image with the photoreceptor of Example 1 under low potential development conditions, it is preferable to use toner having a small weight average particle diameter.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

The electrophotographic photoreceptor in accordance with the present invention is suitable for use in copying machines, printers, facsimiles, and other image forming devices exploiting electrophotography. Especially, the electrophotographic photoreceptor in accordance with the present invention is suitable for use when an image is developed with tiny toner under low electric field conditions.

TABLE 1

| Photoreceptor | Charge transporting substance | weight ratio | Mobility at $E = 10^5$ V/cm ($10^{-6}$ cm$^2$/V · s) | Slope a in Eq. (1) ($10^{-4}$) | Image characteristics Development conditions: Normal | Image characteristics Development conditions: Low potential |
|---|---|---|---|---|---|---|
| Example 1 | Formula (2) | 1.8 | 4.16 | 2.18 | Good | Good |
| Example 2 | Formula (3) | 1.8 | 4.27 | 2.23 | Good | Good |
| Example 3 | Formula (4) | 1.8 | 3.86 | 2.31 | Good | Good |
| Example 4 | Formula (5) | 1.8 | 6.05 | 2.12 | Good | Good |
| Example 5 | Formula (6) | 1.8 | 3.05 | 2.35 | Good | Good |
| Example 6 | Formula (2) | 1.0 | 7.03 | 2.10 | Good | Good |
| Comparative Example 1 | Formula (2) | 3.1 | Unmeasurable | Unmeasurable | Low image density | Low image density |
| Comparative Example 2 | Formula (7) | 1.6 | 1.05 | 5.26 | Good | Low image density |
| Comparative Example 3 | Formula (8) | 2.0 | 0.96 | 10.04 | Good | Low image density |

In Table 1, the weight ratio indicates parts by weight of the binder resin 17 for a charge transporting layer, with respect to 1 part by weight of the charge transporting substance 13. In addition, in Table 1, "unmeasurable" indicates that the value is too small to detect.

As shown in Table 1, when the carrier mobility at an electric field intensity E of $1\times10^5$ V/cm is $2\times10^{-6}$ cm$^2$/(V·s) or greater, and the slope a in equation 1 is $5\times10^{-4}$ or less in an electric field range of $5\times10^4<E<1\times10^5$, good image characteristics are achieved under both normal and low electric potential development conditions.

In addition, results of the repetition durability tests indicate that image characteristics were good after the completion of a copying process of 100,000 sheets in Example 1, whilst fogging occurred in Example 6. This suggests that the photoreceptor of Example 6 had its photosensitive layer worn out in the repetition durability test and the photoreceptor could not retain its charging ability. It is thus understood that control- While the invention is susceptible to various modifications and alternative forms, a specific embodiment and examples of the invention were given merely to describe one technical aspect of the invention. It should be understood that it is not intended to limit the invention to the particular forms disclosed, but on the contrary, the invention is to cover all modifications, equivalents, and alternatives falling within the scope of the invention as defined in the appended claims.

What is claimed is:

1. An electrophotographic photoreceptor, comprising:

a photosensitive layer on a conductive support, the photosensitive layer containing at least a charge generating substance and a charge transporting substance, a mobility of electric charges in the photosensitive layer in an electric field having an intensity of $1\times10^5$ V/cm being $2\times10^{-6}$ cm$^2$/(V·s) or greater, and a slope a in equation 1 being $5\times10^{-4}$ or less:

$$\log \mu = a \times \sqrt{E} + b \quad \text{(Eq.1)}$$

where μ is the mobility, in $cm^2/(V \cdot s)$, of the electric charges in the photosensitive layer at $5\times10^4$ V/cm<E<$1\times10^5$ V/cm, where E is an intensity of an electric field, and a and b are real numbers;

the charge generating substance being oxotitanium phthalocyanine, the charge transporting substance has a structure set forth by general formula (1):

(1)

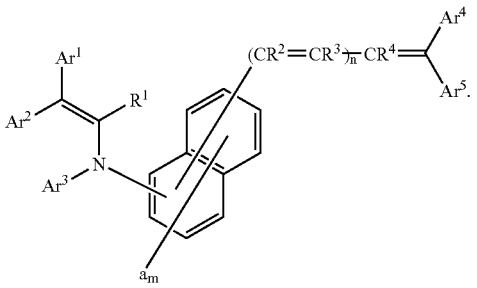

where $Ar^1$ and $Ar^2$ are mutually independent and each of them is either an aryl group which is substituted or unsubstituted, or a heterocyclic group which is substituted or unsubstituted; $Ar^3$ is any one of an aryl group which is substituted or unsubstituted, a heterocyclic group which is substituted or unsubstituted, an aralkyl group which is substituted or unsubstituted, and an alkyl group which is substituted or unsubstituted; $Ar^4$ and $Ar^5$ are mutually independent and each of them is any one of a hydrogen atom, an aryl group which is substituted or unsubstituted, a heterocyclic group which is substituted or unsubstituted, an aralkyl group which is substituted or unsubstituted, and an alkyl group which is substituted or unsubstituted; not both $Ar^4$ and $Ar^5$ are a hydrogen atom; $Ar^4$ and $Ar^5$ may form a ring structure by bonding each other through an atom or an atomic group; the moiety indicated by a is any one of an alkyl group which is substituted or unsubstituted, an alkoxy group which is substituted or unsubstituted, a dialkylamino group which is substituted or unsubstituted, an aryl group which is substituted or unsubstituted, a halogen atom, and a hydrogen atom; m is an integer from 1 to 6; when $m \geqq 2$, the moieties indicated by a are either identical or different, or bond with each other to form a ring structure; $R^1$ is any one of a hydrogen atom, a halogen atom, and an alkyl group which is substituted or unsubstituted; $R^2$, $R^3$ and $R^4$ are mutually independent and each of them is any one of a hydrogen atom, an alkyl group which is substituted or unsubstituted, an aryl group which is substituted or unsubstituted, a heterocyclic group which is substituted or unsubstituted, and an aralkyl group which is substituted or unsubstituted; n is an integer from 0 to 3; when n=2 or n=3, the moieties indicated by $R^2$ are either identical or different and the moieties indicated by $R^3$ are either identical or different; and when n=0, $Ar^3$ is a heterocyclic group which is substituted or unsubstituted, there being excluded substances represented by the following formulas (2) and (4) and a substance represented by the general formula (1) where each of $Ar^1$, $Ar^2$ and $Ar^5$ is a phenyl group, $Ar^3$ is a naphthyl group, $Ar^4$ is a hydrogen atom, "a" is a hydrogen atom, and "m" is 6, and "n" is 1, and each of $R^1$, $R^2$, $R^3$, and $R^4$ is a hydrogen atom:

(2)

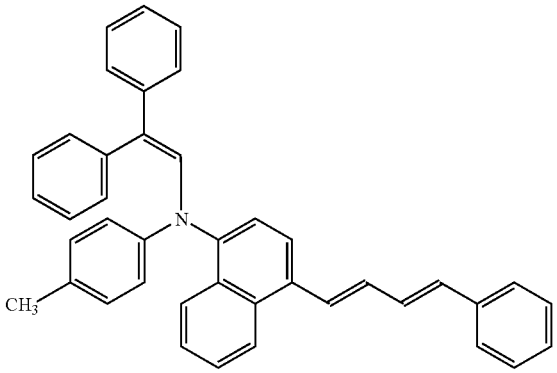

(4)

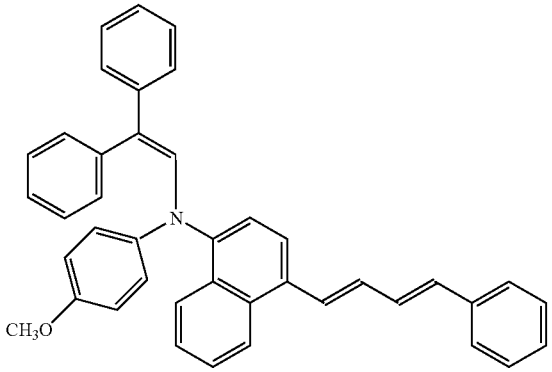

2. The electrophotographic photoreceptor as set forth in claim 1, wherein the photosensitive layer has a layer structure including at least a charge generating layer containing the charge generating substance, and a charge transporting layer containing the charge transporting substance.

3. The electrophotographic photoreceptor as set forth in claim 2, wherein:

the charge transporting layer contains at least the charge transporting substance and a binder resin, and the binder resin is contained in an amount between 1.2 parts by weight and 3 parts by weight, inclusive, with respect to 1 part by weight of the charge transporting substance.

4. The electrophotographic photoreceptor as set forth in claim 2, wherein:

the charge generating layer contains at least the charge generating substance and a binder resin, and the charge generating substance is contained in an amount between 10 percent by weight and 99 percent by weight, inclusive, with respect to a total weight of the charge generating substance and the binder resin.

5. The electrophotographic photoreceptor as set forth in claim 2, wherein the charge transporting layer has a thickness of from 5 μm to 50 μm, inclusive.

6. The electrophotographic photoreceptor as set forth in claim 2, wherein the charge generating layer has a thickness of from 0.05 μm to 5 μm, inclusive.

7. The electrophotographic photoreceptor as set forth in claim 1, further comprising an intermediate layer made of an inorganic layer or an organic layer between the conductive support and the photosensitive layer.

8. An image forming device, comprising an electrophotographic photoreceptor, formed on a conductive support, provided with a photosensitive layer containing at least a charge generating substance and a charge transporting substance, a mobility of electric charges in the photosensitive layer in an electric field having an intensity of $1\times10^5$ V/cm being $2\times10^{-6}$ $cm^2/(V\cdot s)$ or greater, and a slope a in equation 1 being $5\times10^{-4}$ or less:

$$\log \mu = a\times\sqrt{E}+b \quad \text{(Eq.1)}$$

where μ is the mobility, in $cm^2/(V\cdot s)$, of the electric charges in the photosensitive layer at $5\times10^4$ V/cm<E<$1\times10^5$ V/cm, where E is an intensity of an electric field, and a and b are real numbers, the charge generating substance being oxotitanium phthalocyanine, the charge transporting substance has a structure set forth by general formula (1):

(1)

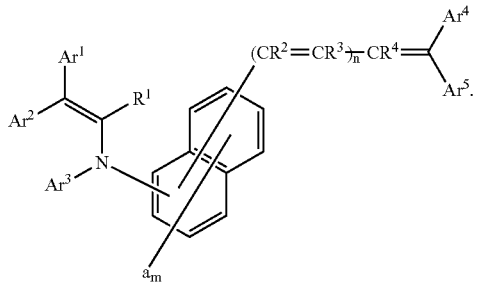

where $Ar^1$ and $Ar^2$ are mutually independent and each of them is either an aryl group which is substituted or unsubstituted, or a heterocyclic group which is substituted or unsubstituted; $Ar^3$ is any one of an aryl group which is substituted or unsubstituted, a heterocyclic group which is substituted or unsubstituted, an aralkyl group which is substituted or unsubstituted, and an alkyl group which is substituted or unsubstituted; $Ar^4$ and $Ar^5$ are mutually independent and each of them is any one of a hydrogen atom, an aryl group which is substituted or unsubstituted, a heterocyclic group which is substituted or unsubstituted, an aralkyl group which is substituted or unsubstituted, and an alkyl group which is substituted or unsubstituted; not both $Ar^4$ and $Ar^5$ are a hydrogen atom; $Ar^4$ and $Ar^5$ may form a ring structure by bonding each other through an atom or an atomic group; the moiety indicated by a is any one of an alkyl group which is substituted or unsubstituted, an alkoxy group which is substituted or unsubstituted, a dialkylamino group which is substituted or unsubstituted, an aryl group which is substituted or unsubstituted, a halogen atom, and a hydrogen atom; m is an integer from 1 to 6; when m ≧2, the moieties indicated by a are either identical or different, or bond with each other to form a ring structure; $R^1$ is any one of a hydrogen atom, a halogen atom, and an alkyl group which is substituted or unsubstituted; $R^2$, $R^3$ and $R^4$ are mutually independent and each of them is any one of a hydrogen atom, an alkyl group which is substituted or unsubstituted, an aryl group which is substituted or unsubstituted, a heterocyclic group which is substituted or unsubstituted, and an aralkyl group which is substituted or unsubstituted; n is an integer from 0 to 3; when n=2 or n=3, the moieties indicated by $R^2$ are either identical or different and the moieties indicated by $R^3$ are either identical or different; and when n=0, $Ar^3$ is a heterocyclic group which is substituted or unsubstituted, there being excluded substances represented by the following formulas (2) and (4) and a substance represented by the general formula (1) where each of Arhu1, $Ar^2$ and $Ar^5$ is a phenyl group, $Ar^3$ is a naphthyl group, $Ar^4$ is a hydrogen atom, "a" is a hydrogen atom, and "m" is 6, and "n" is 1. and each of $R^1$, $R^2$, $R^3$, and $R^4$ is a hydrogen atom:

(2)

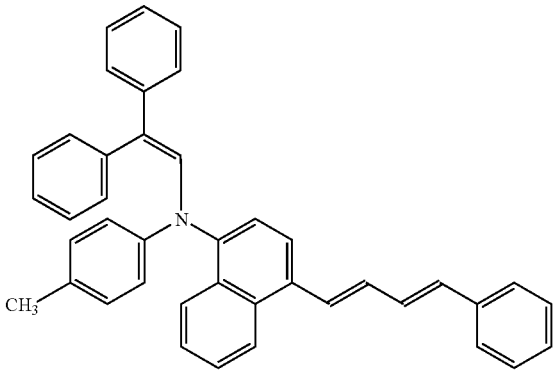

(4)

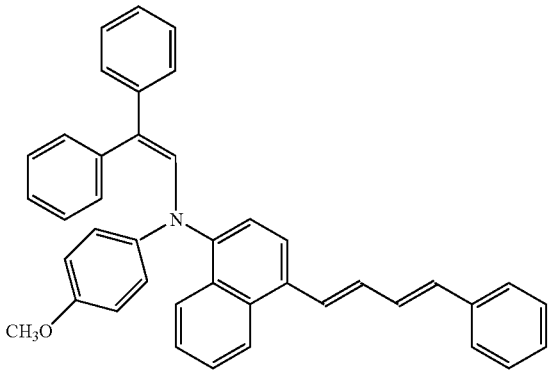

9. The electrophotographic photoreceptor of claim 1, wherein the charge transporting substance is represented by formula (3):

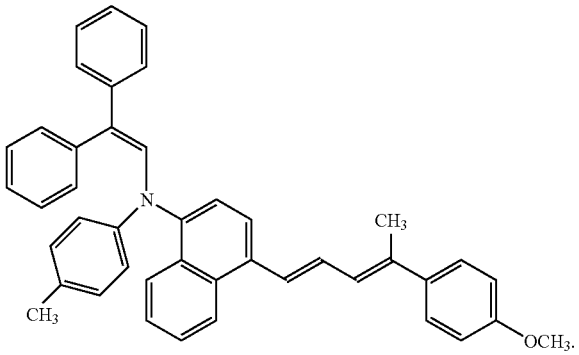

10. The electrophotographic photoreceptor of claim 1, wherein the charge transporting substance is represented by formula:
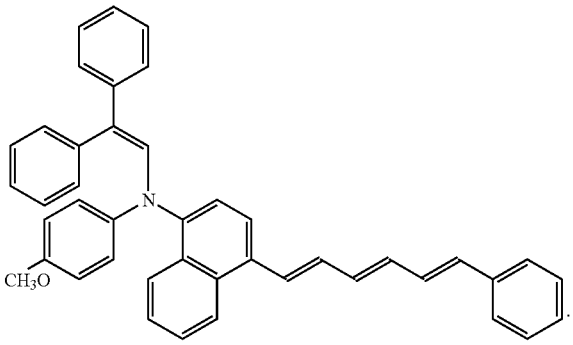
.
11. The electrophotographic photoreceptor of claim 1, wherein the charge transporting substance is represented by formula:
(6)
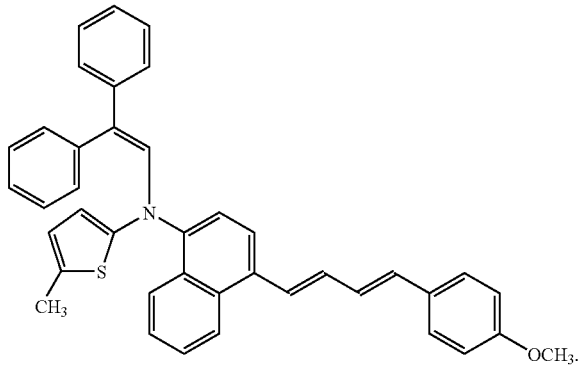
.
* * * * *